US007883753B2

(12) United States Patent
Beer et al.

(10) Patent No.: US 7,883,753 B2
(45) Date of Patent: Feb. 8, 2011

(54) RECORDING SHEETS FOR INK JET PRINTING

(75) Inventors: Robert Beer, Marly (CH); Rolf Steiger, Praroman-le-Mouret (CH)

(73) Assignee: ILFORD Imaging Switzerland GmbH (CH)

( * ) Notice: Subject to any disclaimer, the term of this patent is extended or adjusted under 35 U.S.C. 154(b) by 1092 days.

(21) Appl. No.: 11/637,428

(22) Filed: Dec. 11, 2006

(65) Prior Publication Data

US 2007/0092667 A1 Apr. 26, 2007

Related U.S. Application Data

(63) Continuation-in-part of application No. 10/754,356, filed on Jan. 9, 2004, now abandoned.

(30) Foreign Application Priority Data

Jan. 10, 2003 (EP) ..... 03405007

(51) Int. Cl.
*B41M 5/50* (2006.01)

(52) U.S. Cl. ..... 428/32.36; 427/146

(58) Field of Classification Search ..... None
See application file for complete search history.

(56) References Cited

U.S. PATENT DOCUMENTS

| | | | |
|---|---|---|---|
| 5,055,019 | A | 10/1991 | Meyer et al. |
| 5,073,448 | A | 12/1991 | Vieira et al. |
| 6,156,419 | A | 12/2000 | Brugger et al. |
| 2002/0064634 | A1 | 5/2002 | Baetting et al. |
| 2002/0164459 | A1 | 11/2002 | Steiger |
| 2003/0081103 | A1 | 5/2003 | Ishimaru et al. |

FOREIGN PATENT DOCUMENTS

| | | | |
|---|---|---|---|
| DE | 3823895 | C1 | 7/1988 |
| DE | 100 20 346 | A1 | 4/2000 |
| EP | 0 373 573 | A1 | 12/1989 |
| EP | 0 534 634 | A1 | 9/1992 |
| EP | 0 559 324 | A1 | 2/1993 |
| EP | 0 685 345 | A1 | 5/1995 |
| EP | 0 875 394 | A1 | 4/1998 |
| EP | 1 197 345 | A1 | 10/2000 |
| EP | 1 231 071 | A1 | 2/2001 |
| EP | 1 262 329 | A2 | 5/2002 |

(Continued)

OTHER PUBLICATIONS

"Ozone Problem with Epson Photo Paper" Hardcopy Supplies Journal 6 (7), 35-36 (2000).

(Continued)

*Primary Examiner*—Bruce H Hess
(74) *Attorney, Agent, or Firm*—Dara L. Onofrio, Esq.; Onofrio Law

(57) ABSTRACT

A recording sheet for ink jet printing is described, which consists of a support having coated thereon at least one ink-receiving layer consisting of binders, a nanocrystalline, nanoporous aluminum oxide or aluminum oxide/hydroxide, wherein the nanocrystalline, nanoporous aluminum oxide or aluminum oxide/hydroxide has been prepared in the absence of acids and has been treated with aluminum chlorohydrate. In a preferred embodiment of the invention the solution of aluminum chlorohydrate is aged at elevated temperature.

15 Claims, 1 Drawing Sheet

FOREIGN PATENT DOCUMENTS

| | | | |
|---|---|---|---|
| EP | 1 262 329 | A3 | 5/2002 |
| GB | 2 088 777 | A | 10/1981 |
| JP | 01-301359 | | 5/1988 |
| JP | 02-276670 | | 5/1989 |
| JP | 03-067684 | | 7/1989 |
| JP | 03-251488 | | 5/1990 |
| JP | 04-067986 | | 7/1990 |
| JP | 04-263983 | | 2/1991 |
| JP | 05-016517 | | 7/1991 |
| JP | 2000-309157 | | 11/2000 |
| JP | 2001-096897 | | 4/2001 |
| WO | WO 00/37574 | | 11/1999 |

OTHER PUBLICATIONS

"Sol-Gel Science" Academic Press, ISBN 0-12-134970-5, 59-78 (1990).

"Liquid Crystal Formation and Diffusion in Dispersions of Colloidal Rods" ISBN 90-393-1987-1, 58-79 (1998).

"A Transparent Porous Alumina" American Ceramic Society Bulletin 54, 286-288 (1975).

"Alumina Sol Preparation from Alkoxides" American Ceramic Society Bulletin 54, 289-290 (1975).

"Alumina gels that form porous transparent $Al_2O_3$" Journal of Materials Science 10, 1856-1860 (1975).

"Adsorption of Gses in Multimolecular Layers" J Journal of the American Chemical Society 60, 309-319 (1938).

RECORDING SHEETS FOR INK JET PRINTING

This application is a continuation-in-part of Ser. No. 10/754,356 filed on Jan. 9, 2004, now abandoned which is incorporated herein by reference.

FIELD OF THE INVENTION

The present invention relates to recording sheets used in ink jet printing containing nanocrystalline, nanoporous aluminum oxides or aluminum oxide/hydroxides prepared in the absence of acids, wherein the surface of these oxides or oxide/hydroxides has been treated with aluminum chlorohydrate, and to coating compositions for the preparation of such recording sheets.

BACKGROUND OF THE INVENTION

Ink jet printing processes are mainly of two types: continuous stream and drop-on-demand.

In continuous stream ink jet printing systems, a continuous ink stream is emitted under pressure through a nozzle. The stream breaks up into droplets at a certain distance from the nozzle. If a specific location on the recording sheet has to be printed the individual droplets are directed to the recording sheet, otherwise they are directed to a collecting vessel. This is done for example by charging unnecessary droplets in accordance with digital data signals and passing them through an electric static field which adjusts the trajectory of these droplets in order to direct them to the collecting vessel. The inverse procedure may also be used wherein uncharged droplets are collected in the collecting vessel.

In the non-continuous process, or the so-called "drop-on-demand" systems, a droplet is generated and expelled from the nozzle in accordance with digital data signals only if a specific location on the recording sheet has to be printed.

The printing speed of modern ink jet printers is always increasing for economical reasons. Recording sheets suitable for these printers therefore need to absorb the inks very quickly. Especially suitable are recording sheets containing nanocrystalline, nanoporous inorganic oxides, preferably aluminum oxides or aluminum oxide/hydroxides.

Such recording sheets available today do not meet all of the required demands. In particular, the light stability and the storage stability of images printed on these recording sheets have to be improved. These images are not particularly stable when they are in contact with ambient air, which normally contains sulfur dioxide and, especially in summer, photochemically generated impurities such as ozone or nitrogen oxides. The images are strongly altered or even destroyed in a short time when they are in contact with ambient air. These phenomena are described for example in "Ozone Problem with Epson Photo Paper", Hardcopy Supplies Journal 6 (7), 35-36 (2000).

In patent application EP 0,373,573 derivatives of polyhydroxybenzenes are proposed as stabilizers for recording sheets for ink jet printing.

Patent application EP 0,534,634 describes the deposition of salt solutions containing at least one bivalent metal cation onto recording sheets for ink jet printing in order to improve the water fastness of the printed images. The copper salts $CuCl_2$, $CuBr_2$, $Cu(NO_3)_2$, $Cu(ClO_3)_2$ and $Cu(C_2H_3O_2)_2$ are mentioned explicitly.

Patent application JP 1-301,359 describes the addition of organic sulfonates or organic sulfates in combination with copper or nickel salts of monocarboxylic acids to recording sheets for ink jet printing in order to improve the light stability of the printed images. The copper salts copper formiate and copper acetate are mentioned explicitly.

In patent application GB 2,088,777 derivatives of phenols and bisphenols are proposed in order to improve the stability of recording sheets containing nanoporous inorganic oxides or oxide/hydroxides.

In patent application EP 0,685,345 the addition of dithiocarbamates, thiocyanates, thiurams or sterically hindered amines to recording sheets containing nanoporous inorganic oxides or oxide/hydroxides is proposed in order to improve their stability.

Patent application WO 00/37,574 describes the addition of bivalent salts of carboxylic acids with at least 4 carbon atoms of copper, nickel, cobalt or manganese to inks as well as to recording sheets for ink jet printing in order to improve the light stability of the printed images. It is mentioned that the bivalent copper salts may be replaced by monovalent copper salts.

Patent application EP 1,197,345 describes the addition of unsubstituted or substituted 1,3-cyclohexanedione to recording sheets for ink jet printing containing nanoporous inorganic oxides or oxide/hydroxides in order to increase the stability of printed images when these are in contact with contaminated ambient air.

Patent application EP 1,231,071 proposes the addition of the salts copper(I) chloride, copper(I) bromide or copper(I) sulfite monohydrate of monovalent copper to recording sheets for ink jet printing containing nanoporous inorganic oxides or oxide/hydroxides in order to increase the stability of printed images when these are in contact with contaminated ambient air.

Patent application EP 1,262,329 discloses that poly(aluminum hydroxychloride) may be added to recording sheets for ink jet printing containing aluminum oxide/hydroxide, in particular pseudo-boehmite. Aluminum oxide/hydroxide, as disclosed in patent applications JP 02-276,670, JP 03-067,684, JP 03-251,488, (ICH-302 CIP) JP 04-067,986, JP 04-263,983 and JP 05-016,517 may be used as nanoporous inorganic compound in the ink-receiving layer.

These patent applications disclose the preparation of aluminum oxide/hydroxide from aluminum alkoxides in the presence of acids. In particular, patent application JP 05-016,517 discloses the preparation of aluminum oxide/hydroxide from aluminum isopropoxide in the presence of acetic acid.

All these proposed additives however do not sufficiently increase the stability of printed images on recording sheets for ink jet printing containing nanocrystalline, nanoporous inorganic oxides or oxide/hydroxides when these are in contact with contaminated ambient air. In particular, all reducing additives are quickly oxidized by oxygen or the impurities contained in the ambient air and therefore rapidly loose their stabilizing behavior. Some of the proposed additives may also be transformed into colored compounds when they are in contact with ambient air, leading to an unwanted degradation of the brightness of the recording sheets or of the images printed thereon.

The colloidal, nanoporous aluminum oxide/hydroxide that is very often used in recording sheets is normally prepared in the Yoldas sol-gel process by the hydrolysis of aluminum alkoxides, as described in the book by C. F. Brinker and G. W Scherer, "Sol-Gel Science", Academic Press, 1990, ISBN 0-12-134970-5, pages 59-78. The addition of an aqueous acid, for example hydrochloric acid, nitric acid, acetic acid or lactic acid, is always a step during the preparation process, either before, during or after hydrolysis of the aluminum alkoxides. Otherwise no clear sol is obtained.

This process is described by B. E. Yoldas in "A Transparent Porous Alumina Sol", American Ceramic Society Bulletin 54, 286-288 (1975), B. E. Yoldas in "Alumina Sol Preparation from Alkoxides", American Ceramic Society Bulletin 54, 289-290 (1975) and B. E. Yoldas in "Alumina gels that form porous transparent $Al_2O_3$", Journal of Materials Science 10, 1856-1860 (1975). After hydrolysis, the solvents of the reaction mixture are evaporated in order to isolate the nanocrystalline, nanoporous aluminum oxide/hydroxide as a solid.

The preparation of colloidal boehmite rods is described by M. P. B van Bruggen in "Liquid Crystal Formation and Diffusion in Dispersions of Colloidal Rods", 1998, ISBN 90-393-1987-1, page 59. Here, hydrochloric acid is used in the hydrolysis mixture of aluminum-iso-propoxide and aluminum-sec-butoxide.

Patent DE 3,823,895, on the other hand, describes a process for the preparation of nanocrystalline, nanoporous aluminum oxide/hydroxide, wherein the whole preparation process takes place in the absence of acids, before, during or after hydrolysis of the aluminum alkoxides.

Preferably the nanocrystalline, nanoporous aluminum oxide/hydroxide contains one or more elements of the rare earth metal series of the periodic system of the elements as described in patent application EP 0,875,394.

The treatment of colloidal aluminum oxide or aluminum oxide/hydroxide prepared in the presence of acids with aluminum chlorohydrate is described by M. P. B van Bruggen in "Liquid Crystal Formation and Diffusion in Dispersions of Colloidal Rods", 1998, ISBN 90-393-1987-1, pages 58-79. The aluminum chlorohydrate is added as a solid to the dispersion of aluminum oxide or aluminum oxide/hydroxide.

There is therefore still a need to improve, in addition to the ink absorption capacity, the image quality, the water fastness, the light stability, the storage stability of printed recording sheets containing nanocrystalline, nanoporous aluminum oxide or aluminum oxide/hydroxide when they are in contact with ambient air containing impurities such as ozone, nitrogen oxides or sulfur dioxide and, in particular bronzing. "Bronzing" is the formation of dye deposits with a metallic shiny gloss on the surface of a printed recording sheet. A printed recording sheet with bronzing shows different colors when viewed at different viewing angles. Dyes from aqueous inks do not penetrate into the interior of the recording sheet, but are deposited on the surface, deteriorating image quality and smudge behavior. Bronzing is in most cases more pronounced in printed recording sheets that have been exposed to light than in freshly printed recording sheets.

SUMMARY OF THE INVENTION

An objective of the invention is to provide recording sheets containing nanoporous nanocrystalline, nanoporous aluminum oxide or aluminum oxide/hydroxide with improved storage stability when they are in contact with ambient air, where images recorded thereon can be observed by both reflected and transmitted light, and consist of a support having coated thereon at least one ink-receiving layer and with no or reduced bronzing, in particular after exposure to light or to humidity changes.

We have found that the storage stability of such recording sheets for ink jet printing when they are in contact with contaminated ambient air is significantly improved when the nanocrystalline, nanoporous aluminum oxide or aluminum oxide/hydroxide that is used is treated at the surface with aluminum chlorohydrate. Images printed onto such recording sheets according to the invention show considerably less change of colors and/or dye losses when they are in contact with ambient air containing impurities such as ozone, nitrogen oxides or sulfur dioxide in comparison to images printed onto recording sheets containing untreated aluminum oxide or aluminum oxide/hydroxide.

Bronzing is much improved in such recording sheets, where the nanocrystalline, nanoporous aluminum oxide or aluminum oxide/hydroxide has been prepared in the complete absence of acids and its surface has been treated with aluminum chlorohydrate in comparison to recording sheets, where the nanocrystalline, nanoporous aluminum oxide or aluminum oxide/hydroxide has been prepared in the presence of acids and its surface has been treated with aluminum chlorohydrate.

The recording sheets for ink jet printing according to the invention contain in the coated layers, besides the nanocrystalline, nanoporous aluminum oxide or aluminum oxide/hydroxide treated with aluminum chlorohydrate one or more binders.

Other objects, features and advantages of the present invention will be apparent when the detailed description of the preferred embodiment of the invention are considered with reference to the drawings which should be construed in an illustrative and not limiting sense as follows:

DETAILED DESCRIPTION OF THE INVENTION

Figure 1:
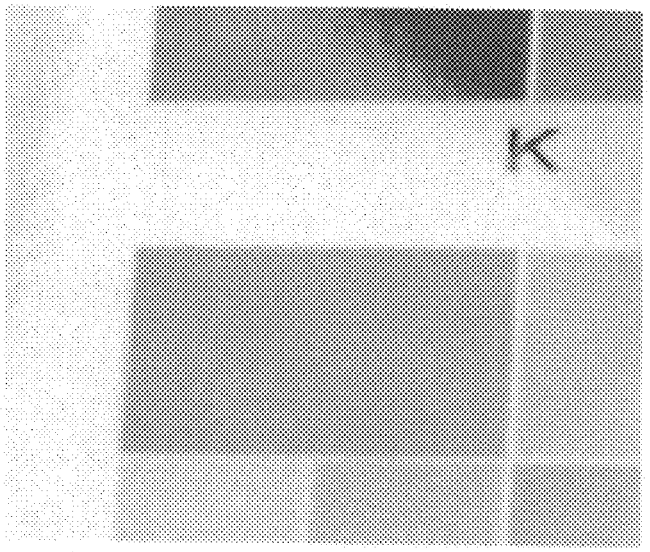
FIG. 1 shows a photograph of a sample of Example 5b after printing with the ink jet printer HP 6540. No bronzing is visible.

We have found that the storage stability of such recording sheets for ink jet printing when they are in contact with contaminated ambient air is significantly improved when the nanocrystalline, nanoporous aluminum oxide or aluminum oxide/hydroxide that is used is treated at the surface with aluminum chlorohydrate.

Bronzing is much improved in such recording sheets, where the nanocrystalline, nanoporous aluminum oxide or aluminum oxide/hydroxide has been prepared in the complete absence of acids and its surface has been treated with aluminum chlorohydrate in comparison to recording sheets, where the nanocrystalline, nanoporous aluminum oxide or aluminum oxide/hydroxide has been prepared in the presence of acids and its surface has been treated with aluminum chlorohydrate.

The amount of aluminum chlorohydrate of formula $Al_2(OH)_5Cl.2.5\ H_2O$ is from 0.1 to 7 mole percent relative to $Al_2O_3$, preferably from 0.5 to 4 mole percent relative to $Al_2O_3$.

The aluminum chlorohydrate may be added to the aqueous dispersions of aluminum oxide or aluminum oxide/hydroxide as a solid or as an aqueous solution.

The addition in the form of an aqueous solution, which has been aged for a prolonged period, preferably from 2 hours to 168 hours at a temperature between 25° C. and 100° C., is preferred. Especially preferred aging conditions are 24 hours at a temperature of 50° C. or 2 hours at a temperature of 90° C.

The aluminum chlorohydrate is preferably added to the aqueous dispersion of aluminum oxide or aluminum oxide/ hydroxide as a solid or as an aqueous solution. The other ingredients, such as binders, surfactants etc., are added afterwards.

Nanocrystalline, nanoporous aluminum oxides or aluminum oxide/hydroxides prepared in the complete absence of acids are preferred.

Preferred as nanocrystalline, nanoporous aluminum oxide is $\gamma$-$Al_2O_3$ and as nanocrystalline, nanoporous aluminum oxide/hydroxide an aluminum oxide/hydroxide reacted with salts of the rare earth metal series as described in patent application EP 0'875'394. This nanocrystalline, nanoporous aluminum oxide/hydroxide contains one or more elements of the rare earth metal series of the periodic system of the elements with atomic numbers 57 to 71, preferably in a quantity from 0.2 to 2.5 mole percent relative to $Al_2O_3$. Especially preferred as nanocrystalline, nanoporous aluminum oxide/hydroxide is pseudo-boehmite, an agglomerate of aluminum oxide/hydroxide of formula $Al_2O_3.nH_2O$ where n is from 1 to 1.5, or pseudo-boehmite reacted with the salts of the rare earth metal series as also described in patent application EP 0,875,394. This nanocrystalline, nanoporous pseudo-boehmite contains one or more elements of the rare earth metal series of the periodic system of the elements with atomic numbers 57 to 71, preferably in a quantity from 0.2 to 2.5 mole percent relative to $Al_2O_3$.

It has been found that only the addition of nanoporous substances having a pore volume of $\mu$20 ml/100 g, as determined by the BET isotherm method, to the ink receiving layers considerably increases the absorption rate and the absorption capacity for aqueous inks. Only such inorganic oxides or oxide/hydroxides should be considered as being "nanoporous". The BET isotherm method is described by S. Brunauer, P. H. Emmet and I. Teller in "Adsorption of Gases in Multimolecular Layers", Journal of the American Chemical Society 60, 309 (1938).

The recording sheet may contain, in addition to the nanocrystalline, nanoporous aluminum oxides or aluminum oxide/hydroxides, other inorganic oxides or oxide/hydroxides not being considered to be nanoporous according to the preceding definition.

In a preferred embodiment of the invention the recording sheet contains, in addition to the treated nanocrystalline, nanoporous aluminum oxide or aluminum oxide/hydroxide, salts of monovalent copper such as copper(I) chloride, copper(I) bromide or copper(I) sulfite monohydrate as described in patent application EP 1,231,071.

It is especially preferred if, in addition to the treated nanocrystalline, nano-porous aluminum oxide or aluminum oxide/hydroxide and the salts of monovalent copper, compounds of formulas Ia (diketo form) and Ib (enol form), as described in patent application EP 1,197,345, are incorporated into the recording sheet,

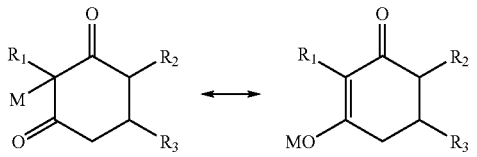

Ia Ib wherein in formulas Ia and Ib

M represents a hydrogen cation, a metal cation such as Li, Na or K, a triethanolamine cation or an ammonium cation optionally substituted by one or more alkyl or substituted alkyl groups each having from 1 to 18 C atoms;

$R_1$ represents hydrogen, alkyl with 1 to 12 C atoms or substituted alkyl with 2 to 6 C atoms, wherein the substituents are selected from the group consisting of CN, COOH, OH and $COOR_4$, where $R_4$ represents alkyl with 1 to 12 C atoms and $R_2$, $R_3$ independently represent hydrogen, alkyl with 1 to 6 C atoms or substituted alkyl with 2 to 6 C atoms, wherein the substituents are selected from the group consisting of CN, COOH, OH and $COOR_5$, where $R_5$ represents alkyl with 1 to 12 C atoms.

In a further preferred embodiment of the invention, the recording sheet contains, in addition to the treated nanocrystalline, nanoporous aluminum oxide or aluminum oxide/hydroxide, organic sulfur compounds as for example thiodiethylene glycol.

The binders are in most cases water-soluble polymers. Especially preferred are film forming polymers.

The water-soluble polymers include for example natural polymers or modified products thereof such as albumin, gelatin, casein, starch, gum arabicum, sodium or potassium alginate, hydroxyethyl cellulose, carboxymethyl cellulose, $\alpha$-, $\beta$- or $\gamma$-cyclodextrine and the like. In the case where one of the water-soluble polymers is gelatin, all known types of gelatin may be used as for example acid pigskin or limed bone gelatin, acid or base hydrolyzed gelatin, but also derivatised gelatins like for instance phthalaoylated, acetylated or carbamoylated gelatin or gelatin derivatised with the anhydride of trimellitic acid.

A preferred natural binder is gelatin.

Synthetic binders may also be used and include for example polyvinyl alcohol, polyvinyl pyrrolidone, completely or partially saponified products of copolymers of vinyl acetate and other monomers; homopolymers or copolymers of unsaturated carboxylic acids such as (meth)acrylic acid, maleic acid, crotonic acid and the like; homopolymers or copolymers of sulfonated vinyl monomers such as vinylsulfonic acid, styrene sulfonic acid and the like. Furthermore homopolymers or copolymers of vinyl monomers of (meth) acrylamide; homopolymers or copolymers of other monomers with ethylene oxide; polyurethanes; polyacrylamides; polyesters; polyvinyl lactams; acrylamide polymers; substituted polyvinyl alcohol; polyvinyl acetals; polymers of alkyl and sulfoalkyl acrylates and methacrylates; hydrolyzed polyvinyl acetates; polyamides; polyvinyl pyridines; polyacrylic acid; copolymers with maleic anhydride; polyalkylene oxides; methacrylamide copolymers and maleic acid copolymers may be used. All these polymers may also be used as mixtures.

Preferred synthetic binders are polyvinyl alcohol and polyvinyl pyrrolidone or mixtures thereof.

These polymers may be blended with water insoluble natural or synthetic high molecular weight compounds, particularly with acrylate latices or with styrene acrylate latices.

Although not specifically claimed in this invention water insoluble polymers are nevertheless considered to be part of the system.

The polymers mentioned above having groups with the possibility to react with a cross-linking agent may be cross-linked or hardened to form essentially water insoluble layers. Such cross-linking bonds may be either covalent or ionic. Cross-linking or hardening of the layers allows for the modification of the physical properties of the layers, like for instance their water absorption capacity or the resistance against layer damage.

The cross-linking agents or hardeners are selected depending on the type of the water-soluble polymers to be cross-linked.

Organic cross-linking agents and hardeners include for example aldehydes (such as formaldehyde, glyoxal or glutaraldehyde), N-methylol compounds (such as dimethylol urea or methylol dimethylhydantoin), dioxanes (such as 2,3-dihydroxydioxane), reactive vinyl compounds (such as 1,3,5-trisacrylolyl hexahydro-s-triazine or bis-(vinylsulfonyl) methyl ether), reactive halogen compounds (such as 2,4-dichloro-6-hydroxy-s-triazine); epoxides; aziridines; carbamoyl pyridinium compounds or mixtures of two or more of the above mentioned cross-linking agents.

Inorganic cross-linking agents or hardeners include for example chromium alum, aluminum alum or boric acid.

The layers may also contain reactive substances that cross-link the layers under the influence of ultraviolet light, electron beams, X-rays or heat.

The layers may further be modified by the addition of fillers. Possible fillers are for instance kaolin, Ca- or Ba-carbonates, silicium dioxide, titanium dioxide, bentonites, zeolites, aluminum silicate, calcium silicate or colloidal silicon dioxide. Organic inert particles such as polymer beads may also be used. These beads may consist of polyacrylates, polyacrylamides, polystyrene or different copolymers of acrylates and styrene. The fillers are selected according to the intended use of the printed images. Some of these compounds cannot be used if the printed images are to be used as transparencies. However they are of interest in cases where the printed images are be to used as remission pictures. Very often, the introduction of such fillers causes a wanted matte surface.

The recording sheets may also contain still other water-soluble metal salts, as for example salts of the alkaline earth metals or salts of the rare earth metal series.

The recording sheets according to the invention comprise a support having coated thereon at least one ink-receiving layer, and, optionally, auxiliary layers.

A wide variety of supports are known and commonly used in the art. They include all those supports used in the manufacture of photographic materials. This includes clear films made from cellulose esters such as cellulose triacetate, cellulose acetate, cellulose propionate or cellulose acetate/butyrate, polyesters such as polyethylene terephthalate or polyethylene naphthalate, polyamides, polycarbonates, polyimides, polyolefins, polyvinyl acetals, polyethers, polyvinyl chloride and polyvinylsulfones. Polyester film supports, and especially polyethylene terephthalate or polyethylene naphthalate are preferred because of their excellent dimensional stability characteristics. The usual supports used in the manufacture of opaque photographic materials may be used including for example baryta paper, polyolefin coated papers, voided polyester as for instance Meline® manufactured by DuPont. Especially preferred are polyolefin coated papers or voided polyester.

When such support materials, in particular polyester, are used, a subbing layer is advantageously coated first to improve the bonding of the ink receiving layers to the support. Useful subbing layers for this purpose are well known in the photographic industry and include for example terpolymers of vinylidene chloride, acrylonitrile and acrylic acid or of vinylidene chloride, methyl acrylate and itaconic acid. In place of the use of a subbing layer, the surface of the support may be subjected to a corona-discharge treatment or a corona-aerosol treatment before the coating process.

Also used as supports are uncoated papers, comprising all different types of papers varying widely in their composition and in their properties. Pigmented papers and cast-coated papers may also be used, as well as metal foils, such as foils made from aluminum.

The layers may also be coated onto textile fiber materials consisting for example of polyamides, polyesters, cotton, viscose and wool.

The ink-receiving layers according to the invention are in general coated from aqueous solutions or dispersions containing all necessary ingredients. In many cases, surfactants are added to those coating solutions in order to improve the coating behavior and the evenness of the layers. Besides being necessary for coating purposes, these compounds may have an influence on the image quality and may therefore be selected with this specific objective in mind. Although not specifically claimed in this invention surfactants nevertheless form an important part of the invention.

In addition to the above mentioned ingredients, recording sheets according to the invention may contain additional compounds aimed at further improving their performance, as for example brightening agents to improve the whiteness, such as stilbenes, coumarines, triazines, oxazoles or others compounds known to someone skilled in the art.

Light stability may be improved by adding UV absorbers such as 2-hydroxybenzotriazoles, 2-hydroxybenzophenones, derivatives of triazine or derivatives of cinnamic acid. The amount of UV absorber may vary from 200 $mg/m^2$ to 2000 $mg/m^2$, preferably from 400 $mg/m^2$ to 1000 $mg/m^2$. The UV absorber may be added to any of the layers of the recording sheet according to the invention. It is preferred that, however, if it is added, it should be added to the topmost layer.

It is further known that images produced by ink jet printing may be protected from degradation by the addition of radical scavengers, stabilizers, reducing agents and antioxidants. Examples of such compounds are sterically hindered phenols, sterically hindered amines, chromanols, ascorbic acid, phosphinic acids and their derivatives, sulfur containing compounds such as sulfides, mercaptans, thiocyanates, thioamides or thioureas.

The above-mentioned compounds may be added to the coating solutions as aqueous solutions. In the case where these compounds are not sufficiently water-soluble, they may be incorporated into the coating solutions by other common techniques known in the art. The compounds may for example be dissolved in a water miscible solvent such as lower alcohols, glycols, ketones, esters, or amides. Alternatively, the compounds may be added to the coating solutions as fine dispersions, as oil emulsions, as cyclodextrine inclusion compounds or incorporated into latex particles.

Typically, the recording sheet according to the invention has a thickness in the range of 0.5 μm to 100 μm dry thickness, preferably in the range of 5 μm to 50 μm dry thickness.

The coating solutions may be coated onto the support by any number of suitable procedures. Usual coating methods include for example extrusion coating, air knife coating, doctor blade coating, cascade coating and curtain coating. The coating solutions may also be applied using spray techniques. The ink-receiving layers may be built up from several single layers that can be coated one after the other or simultaneously. It is likewise possible to coat a support on both sides with ink-receiving layers. It is also possible to coat an antistatic layer or an anticurl layer on the backside. The selected coating method however is not to be considered limiting for the present invention.

Inks for ink jet printing consist in essence of a liquid vehicle and a dye or pigment dissolved or suspended therein. The liquid vehicle for ink jet inks consists in general of water or a mixture of water and a water miscible organic solvent such as ethylene glycol, higher molecular weight glycols, glycerol, dipropylene glycol, polyethylene glycol, amides, polyvinyl pyrrolidone, N-methylpyrrolidone, cyclohexyl pyrrolidone, carboxylic acids and their esters, ethers, alcohols, organic sulfoxides, sulfolane, dimethylformamide, dimethylsulfoxide, cellosolve, polyurethanes, acrylates and the like.

The non-aqueous parts of the ink generally serve as humefactants, cosolvents, viscosity regulating agents, ink penetration additives or drying agents. The organic compounds have in most cases a boiling point, which is higher than that of water. In addition, aqueous inks used for printers of the continuous stream type may contain inorganic or organic salts to increase their conductivity. Examples of such salts are nitrates, chlorides, phosphates and salts of water-soluble organic acids such as acetates, oxalates and citrates. The dyes and pigments suitable for the preparation of inks useable with the recording sheets according to the invention cover practically all classes of known coloring compounds. Dyes or pigments typically used for this purpose are described in patent application EP 0'559'324. The recording sheets according to the invention are meant to be used in conjunction with most of the inks representing the state of the art.

Other additives present in inks are for instance surfactants, optical brighteners, UV absorbers, light stabilizers, biocides, precipitating agents such as multivalent metal compounds and polymeric additives.

This description of inks is for illustration only and is not to be considered as limiting for the purpose of the invention.

The present invention will be illustrated in more detail by the following examples without limiting the scope of the invention in any way.

Experimental Coatings

The coating solutions are prepared by dispersion of the nanocrystalline, nanoporous aluminum oxide/hydroxide in water containing a small amount of acid in order to facilitate the dispersion of the aluminum oxide/hydroxide. The use of acids in the preparation of the coating solutions has no connection at all with the presence or absence of acids during the preparation of the nanocrystalline, rianoporous aluminum oxide/hydroxide.

140 g/m$^2$ of the coating solutions as described in the following examples were coated at a temperature of 40° C. onto a polyethylene coated paper support. The coated support was then dried for 60 minutes at a temperature of 30° C. 1 m$^2$ of the coated support contains, in addition to the other coating ingredients, 21.1 g of nanocrystalline, nanoporous aluminum oxide/hydroxide, calculated as $Al_2O_3$, and 2.39 g of polyvinyl alcohol.

Test Methods

The following methods were used to determine the stability of the recording sheets described in the following examples when they are in contact with ambient air and their light stability:

1. Stability In Contact With Ambient Air

Patches of the colors cyan, magenta, yellow and 3K black (mixture of cyan, magenta and yellow) with densities between 0.7 and 1.6 were printed onto the recording sheets according to the invention with an ink jet printer EPSON 890 using original inks. The ink quantity was the same for all patches.

The printed samples were exposed for 7 days in a closed cupboard to ambient air under moderate circulation at a temperature between 20° C. and 25° C. and relative humidity between 35% and 70%.

The density losses of the printed patches were measured with an X-Rite® densitometer. They are expressed as percent loss of initial density of the color patches and as percent loss of initial density of the individual colors of 3K black.

2. Light Stability

Patches of the colors cyan, magenta, yellow and 3K black with an approximate density of 1.60 were printed onto the recording sheets according to the invention with an ink jet printer EPSON 890 using original inks.

The printed samples were irradiated in an ATLAS Ci35A Weather-O-Meter® with a 6500 W Xenon lamp until a total illumination of 10 Mluxh was reached.

The densities of the color patches were measured with an X-Rite® densitometer before and after irradiation. The density losses are expressed as percent losses of initial density.

3. Combined Stability In Contact With Ambient Air And Exposure To Light

Patches of the colors cyan, magenta, yellow and 3K black with densities between 0.7 and 1.6 were printed onto the recording sheets according to the invention with an ink jet printer EPSON 750 using original inks. The ink quantity was the same for all patches.

The printed samples were exposed unsealed to ambient air for 244 days under subdued room light.

These conditions correspond to normally encountered conditions where the printed images are deteriorated at the same time by exposure to light as well as to air impurities.

3. Bronzing

Patches of the colors cyan and blue were printed each with 100% droplet rate onto the recording sheets according to the invention with the ink jet printers Epson SP 890 and HP 6540 using original inks.

Bronzing was determined in freshly printed recording sheets and after an irradiation in an ATLAS Ci35A Weather-O-Meter® with a 6500 W Xenon lamp after a total illumination of 10 Mluxh. This irradiation in the ATLAS Ci35A Weather-O-Meter® is coupled with humidity cycling.

Bronzing (metallic shiny gloss) was visually evaluated and rated on a scale from 0 (no metallic shiny deposits) to 5 (color patches completely covered with metallic shiny deposits).

EXAMPLES

Examples 1a-1c, Comparative Example C-1

Coating solutions 38.0 g of nanocrystalline, nanoporous aluminum oxide/hydroxide, prepared in the absence of acid according to the method of example 1 of patent application DE 3,823,895 (said method being incorporated herein by reference), were dispersed under vigorous mechanical stirring at a temperature of 40° C. in 104 g of aqueous lactic acid (1.7%). Afterwards aqueous aged solutions of aluminum chlorohydrate of formula $Al_2(OH)_5Cl.2.5\,H_2O$ (Locron®, available from Clariant AG, Muttenz, Switzerland) (50%) were added. The amounts (in mole percent relative to $Al_2O_3$) and the aging conditions are indicated in Table 1. Vigorous mechanical stirring was continued for a further 2 hours. Afterwards, 11.4 g of a solution of polyvinyl alcohol with a hydrolysis degree of 88%

(10%, molecular weight 72'000, available as Mowiol 26-88 from Clariant AG, Muttenz, Switzerland) and 25.4 g of a solution of polyvinyl alcohol with a hydrolysis degree of 98% (10%, molecular weight 195'000, available as Mowiol 56 98 from Clariant AG, Muttenz, Switzerland) were added. The total weight of the coating solution was adjusted to 200 g with deionised water and the solution was exposed to ultrasound for 30 seconds. TABLE 1

TABLE 1

| Example | Quantity of aluminum chlorohydrate (mole percent) | Aging conditions of the solution of aluminum chlorohydrate |
|---|---|---|
| 1a | 2 | 5 minutes at 20° C. |
| 1b | 2 | 24 hours at 20° C. |
| 1c | 2 | 168 hours at 20° C. |
| 1d | 2 | 24 hours at 50° C. |
| C-1 | 0 | |

Example 2, Comparative Example C-2

Preparation of Nanocrystalline, Nanoporous Aluminum Oxide/Hydroxide Doped With La (0.2 Mole Percent Relative To $Al_2O_3$)

50 g of nanocrystalline, nanoporous aluminum oxide/hydroxide, prepared in the complete absence of acids according to the method of example 1 of patent application DE 3,823,895, were dispersed at a temperature of 20° C. for 15 minutes under vigorous mechanical stirring in 948 g of doubly distilled water. Afterwards, temperature was increased to 90° C. and stirring was continued for 15 minutes at this temperature. 0.186 g of $LaCl_3$ (available from Fluka Chemie AG, Buchs, Switzerland) were added as a solid and stirring was continued for 120 minutes. The solid was filtered off, washed three times with doubly distilled water and dried at a temperature of 110° C. The lanthanum content is 0.2 mole percent relative to $Al_2O_3$.

Coating Solutions

The nanocrystalline, nanoporous aluminum oxide/hydroxide, prepared in the absence of acid according to the method of example 1 of patent application DE 3'823'895, used in the preparation of the coating solutions of Examples 1a-1 d and Comparative Example C-1, was replaced by nanocrystalline, nanoporous aluminum oxide/hydroxide doped with La (0.2 mole percent), also prepared in the absence of acid, as described above. The amount of aluminum chlorohydrate (in mole percent relative to $Al_2O_3$) and the aging conditions of the solution of aluminum chlorohydrate are indicated in Table 2.

TABLE 2

| Example | Quantity of aluminum chlorohydrate (mole percent) | Aging conditions of the solution of aluminum chlorohydrate |
|---|---|---|
| 2 | 2 | 2 hours at 20° C. |
| C-2 | 0 | |

Examples 3a-3c, Comparative Example C-3

Coating Solutions

The nanocrystalline, nanoporous aluminum oxide/hydroxide, prepared in the absence of acid according to the method of example 1 of patent application DE 3,823,895, used in the preparation of the coating solutions of Examples 1a-1 d and Comparative Example C-1, was replaced by nanocrystalline, nanoporous aluminum oxide/hydroxide Disperal HP14/4 (available from SASOL Germany GmbH, Hamburg, Germany) prepared in the presence of acids. The amount of aluminum chlorohydrate (in mole percent relative to $Al_2O_3$) and the aging conditions of the solution of aluminum chlorohydrate are indicated in Table 3.

TABLE 3

| Example | Quantity of aluminum chlorohydrate (mole percent) | Aging conditions of the solution of aluminum chlorohydrate |
|---|---|---|
| 3a | 1 | 5 minutes at 25° C. |
| 3b | 2 | 5 minutes at 25° C. |
| 3c | 1 | 24 h hours at 50° C. |
| 3d | 2 | 24 h hours at 50° C. |
| C-3 | 0 | |

Example 4, Comparative Example C-4

Coating Solutions

In Example 4, 340 mg of thiodiethylene glycol were added to the prepared coating solution of Example 1a.

In Comparative Example C-4, no thiodiethylene glycol was added to the prepared coating solution of example 1a.

The dried coating of Example 4 contains, in addition to the other ingredients, 242 g/$m^2$ of thiodiethylene glycol.

Examples 5a-5d, Comparative Example C-5

Coating Solutions 38.0 g of nanocrystalline, nanoporous aluminum oxide/hydroxide, prepared in the absence of acid according to the method of example 1 of patent application DE 3,823,895, were dispersed under vigorous mechanical stirring at a temperature of 40° C. in 104 g of aqueous lactic acid (1.7%). Afterwards, aqueous aged solutions of aluminum chlorohydrate of formula $Al_2(OH)_5Cl.2.5\,H_2O$ (50%) were added. The amounts (in mole percent relative to $Al_2O_3$) and the aging conditions are indicated in Table 4. Vigorous mechanical stirring was continued for a further 2 hours. Afterwards, 11.4 g of a solution of polyvinyl alcohol Mowiol 26-88 and 25.4 g of a solution of polyvinyl alcohol Mowiol 56-98 were added. The total weight of the coating solution was adjusted to 200 g with deionised water and the solution was exposed to ultrasound for 30 seconds.

TABLE 4

| Example | Quantity of aluminum chlorohydrate (mole percent) | Aging conditions of the solution of aluminum chlorohydrate |
|---|---|---|
| 5a | 1.5 | — |
| 5b | 2.0 | — |
| 5c | 1.5 | 24 hours at 50° C. |

TABLE 4-continued

| Example | Quantity of aluminum chlorohydrate (mole percent) | Aging conditions of the solution of aluminum chlorohydrate |
|---|---|---|
| 5d | 2.0 | 24 hours at 50° C. |
| C-5 | 0 | — |

Examples 6a-6d, Comparative Example C-6

The nanocrystalline, nanoporous aluminum oxide/hydroxide, prepared in the absence of acid according to the method of example 1 of patent application DE 3,823,895, used in the preparation of the coating solutions of Examples 5a-5d and Comparative Example C-5, was replaced by nanocrystalline, nanoporous aluminum oxide/hydroxide Disperal HP14/4 prepared in the presence of acids. The amounts of aluminum chlorohydrate and the aging conditions were the same as in Table 4.

As shown in FIG. 1 an image of a sample of Example 5b after printing with the ink jet printer HP 6540 is illustrated. No bronzing is visible.

Figure 2:
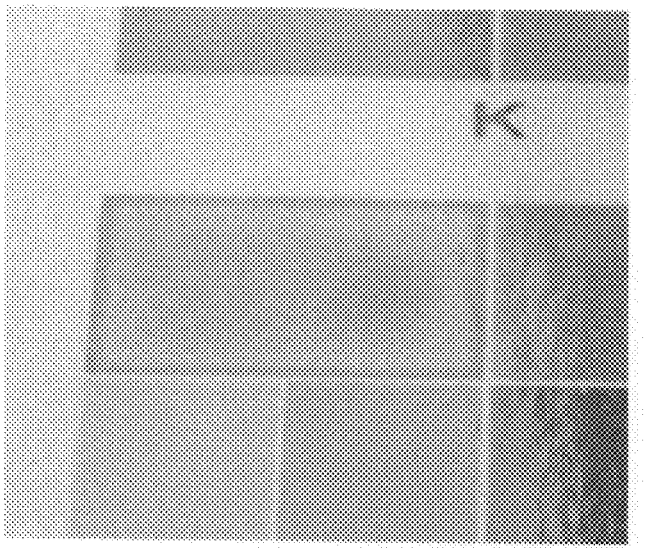
FIG. 2 shows a photograph of bronzing in Example 6b after printing with the ink jet printer HP 6540. There is severe bronzing.

FIG. 2 is a photograph of bronzing in Example 6b after printing with the ink jet printer HP 6540. There is severe bronzing.

Results

The density losses obtained during exposure to ambient air under the indicated testing conditions are listed in Table 5 for recording sheets according to the invention containing nanocrystalline, nanoporous aluminum oxide/hydroxide treated with aluminum chlorohydrate, as well as the density losses during exposure to ambient air for comparative recording sheets containing untreated nanocrystalline, nanoporous aluminum oxide/hydroxide.

TABLE 5

| | Dye density loss in % | | | | | |
|---|---|---|---|---|---|---|
| Example | Cyan | Magenta | Yellow | Cyan (3K) | Magenta (3K) | Yellow (3K) |
| 1a | 4 | 2 | 1 | 14 | 14 | 0 |
| C-1 | 20 | 10 | 1 | 22 | 17 | 0 |
| 3a | 20 | 11 | 4 | | | |
| 3b | 7 | 6 | 1 | | | |
| 3c | 18 | 11 | 3 | | | |
| 3d | 4 | 5 | 1 | | | |
| C-3 | 26 | 14 | 3 | | | |
| 4 | 8 | 0 | 12 | 11 | 4 | 0 |
| C-4 | 12 | 2 | 12 | 11 | 4 | 0 |

A comparison of the results of experimental series 1 in Table 5 immediately shows that the recording sheet for ink jet printing containing nanocrystalline, nanoporous aluminum oxide/hydroxide, prepared in the absence of acid and treated with aluminum chlorohydrate (Example 1a), shows much lower density losses of the cyan and magenta dye in the pure color patches as well as in the 3K patches in comparison to a corresponding recording sheet containing untreated nanocrystalline, nanoporous aluminum oxide/hydroxide (Comparative Example C-1).

A comparison of the results of experimental series 3 in Table 5 immediately shows that the recording sheets for ink jet printing containing nanocrystalline, nanoporous aluminum oxide/hydroxide, prepared in the presence of acid and treated with aluminum chlorohydrate (Examples 3a-3d), show lower density losses of the cyan, magenta and yellow dye in the pure color patches in comparison to a corresponding recording sheet containing untreated nanocrystalline, nanoporous aluminum oxide/hydroxide (Comparative example C-3). The density losses are considerably lower with an amount of aluminum chlorohydrate of 2 mole percent (Examples 3a and 3c) than with an amount of aluminum chlorohydrate of 1 mole percent (Examples 3b and 3 d). The aging of the solution of aluminum chlorohydrate for prolonged periods at higher temperatures further reduces the dye losses (Examples 3a versus 3c and 3b versus 3d).

A comparison of the results of experimental series 1 and 3 in Table 5 further shows that the density losses are smaller when a nanocrystalline, nanoporous aluminum oxide/hydroxide is used that has been prepared in the absence of acids.

A comparison of the results of Examples 4 and Comparative Example C-4 in Table 5 immediately shows that the cyan and magenta density losses are even smaller when the recording sheet additionally contains thiodiethylene glycol.

These samples were printed with an ink jet printer EPSON 890. The density losses obtained during exposure to light are listed in Table 6 for recording sheets according to the invention containing nanocrystalline, nanoporous aluminum oxide/hydroxide treated with aluminum chlorohydrate, as well as the density losses during exposure to light for comparative recording sheets containing untreated nanocrystalline, nanoporous aluminum oxide/hydroxide.

TABLE 6

| | Dye Density Loss in % | | | | | |
|---|---|---|---|---|---|---|
| Example | Cyan | Magenta | Yellow | Cyan (3K) | Magenta (3K) | Yellow (3K) |
| 1a | 12 | 46 | 20 | 6 | 22 | 0 |
| C-1 | 27 | 46 | 28 | 8 | 17 | 0 |

A comparison of the results in Table 6 immediately shows that the recording sheet for ink jet printing containing nanocrystalline, nanoporous aluminum oxide/hydroxide, prepared in the absence of acid and treated with aluminum chlorohydrate (Example 1a), shows lower density losses of the cyan and yellow in comparison to a corresponding recording sheet containing untreated nanocrystalline, nanoporous aluminum oxide/hydroxide (Comparative Example C-1).

These samples were printed with an ink jet printer EPSON 750. The density losses obtained during exposure to light are listed in Table 7 for recording sheets according to the invention containing nanocrystalline, nanoporous aluminum oxide/hydroxide prepared in the absence of acid and treated with aluminum chlorohydrate, as well as the density losses during exposure to light for comparative recording sheets containing untreated nanocrystalline, nanoporous aluminum oxide/hydroxide.

TABLE 7

| | Dye Density Loss in % | | | | | |
|---|---|---|---|---|---|---|
| Example | Cyan | Magenta | Yellow | Cyan (3K) | Magenta (3K) | Yellow (3K) |
| 2 | 40 | 33 | 14 | 48 | 34 | 21 |
| C-2 | 60 | 46 | 19 | 60 | 46 | 33 |

A comparison of the results in Table 7 immediately shows that the recording sheet for ink jet printing containing nanocrystalline, nanoporous aluminum oxide/hydroxide doped with lanthanum, prepared in the absence of acids and treated with aluminum chlorohydrate (Example 2), shows lower density losses of all dyes in comparison to a corresponding recording sheet containing untreated nanocrystalline, nanoporous aluminum oxide/hydroxide doped with lanthanum (Comparative Example C-2).

The density losses obtained during the combined exposure to ambient air and light under the indicated testing conditions are listed in Table 8 for recording sheets according to the invention containing nanocrystalline, nanoporous aluminum oxide/hydroxide prepared in the absence of acids and treated with aluminum chlorohydrate, as well as the density losses obtained during the combined exposure to ambient air and light for comparative recording sheets containing untreated nanocrystalline, nanoporous aluminum oxide/hydroxide.

TABLE 8

| | Dye Density Loss in % | | | |
|---|---|---|---|---|
| Example | Cyan | Magenta | Yellow | 3K through neutral density filter |
| 1b | 46 | 50 | 19 | 45 |
| 1c | 43 | 50 | 21 | 41 |
| C-3 | 63 | 71 | 4 | 62 |

A comparison of the results in Table 8 immediately shows that the recording sheets for ink jet printing containing nanocrystalline, nanoporous aluminum oxide/hydroxide, prepared in the absence of acids and treated with aluminum chlorohydrate (Examples 1a and 1 b), show much lower density losses of the cyan, magenta and yellow dye in comparison to a corresponding recording sheet containing untreated nanocrystalline, nanoporous aluminum oxide/hydroxide prepared in the presence of acids (Comparative Example C-3).

The ratings of the levels of bronzing are listed in Table 9 for recording sheets according to the invention containing nanocrystalline, nanoporous aluminum oxide/hydroxide treated with aluminum chlorohydrate and printed with the ink jet printer HP 6540.

TABLE 9

| Example | Level of bronzing in freshly printed samples | Level of bronzing in printed samples after irradiation |
|---|---|---|
| 5a | 0 | 1 |
| 5b | 0 | 2 |
| 5c | 1 | 2 |
| 5d | 2 | 2 |
| C-5 | 0 | 0 |
| 6a | 1 | 3 |
| 6b | 4 | 3 |
| 6c | 3 | 3 |
| 6d | 4 | 4 |
| C-6 | 0 | 0 |

A comparison of the results in Table 9 immediately shows that the recording sheets for ink jet printing containing nanocrystalline, nanoporous aluminum oxide/hydroxide, prepared in the absence of acid and treated with aluminum chlorohydrate (Examples 5a to 5d), show a considerably lower level of bronzing in comparison to recording sheets containing nanocrystalline, nanoporous aluminum oxide/hydroxide prepared in the presence of acids (Examples 6a to 6d), in particular after irradiation of the printed samples with light.

The ratings of the levels of bronzing are listed in Table 10 for recording sheets according to the invention containing nanocrystalline, nanoporous aluminum oxide/hydroxide treated with aluminum chlorohydrate and printed with the ink jet printer Epson SP 890.

TABLE 10

| Example | Level of bronzing in freshly printed samples |
|---|---|
| 5a | 0 |
| 5b | 0 |
| 5c | 0 |
| 5d | 0 |
| C-5 | 0 |
| 6a | 0 |
| 6b | 0 |
| 6c | 2 |
| 6d | 2 |
| C-6 | 0 |

A comparison of the results in Table 10 immediately shows that the recording sheets for ink jet printing containing nanocrystalline, nanoporous aluminum oxide/hydroxide, prepared in the absence of acid and treated with an aged solution of aluminum chlorohydrate (Examples 5c and 5d), show no bronzing in comparison to recording sheets containing nanocrystalline, nanoporous aluminum oxide/hydroxide prepared in the presence of acids and treated with an aged solution of aluminum chlorohydrate (Examples 6c and 6d).

Finally, variations from the examples given herein are possible in view of the above disclosure. Therefore, although the invention has been described with reference to certain preferred embodiments, it will be appreciated that other binders may be devised, which are nevertheless within the scope and spirit of the invention as defined in the claims appended hereto.

The foregoing description of various and preferred embodiments of the present invention has been provided for purposes of illustration only, and it is understood that numerous modifications, variations and alterations may be made without departing from the scope and spirit of the invention as set forth in the following claims.

The invention claimed is:

1. Recording sheet for ink jet printing having coated onto a support at least one ink-receiving layer containing binders and at least one nanocrystalline, nanoporous aluminum oxide or aluminum oxide/hydroxide, wherein the nanocrystalline, nanoporous aluminum oxide or aluminum oxide/hydroxide has been prepared in the absence of acids and has been treated with aluminum chlorohydrate added as a solid or as an aqueous solution in the quantity from 0.1 to 7.0 mole percent relative to $Al_2O_3$.

2. Recording sheet according to claim 1, wherein the quantity of aluminum chlorohydrate is from 0.5 to 4.0 mole percent relative to $Al_2O_3$.

3. Recording sheet according to claim 1, wherein the aluminum chlorohydrate is added to the aqueous dispersions of aluminum oxide or aluminum oxide/hydroxide as an aqueous solution that has been aged for a period of from 2 hours to 168 hours at temperatures between 25° C. and 100° C.

4. Recording sheet according to claim 1, wherein the recording sheet additionally contains thiodiethylene glycol.

5. Recording sheet according to claim 1, wherein the nanocrystalline, nanoporous aluminum oxide/hydroxide is aluminum oxide/hydroxide or pseudo-boehmite comprising one or more of the elements of the rare earth metal series of the periodic system of the elements with atomic numbers 57 to 71 in an amount of from 0.2 to 2.5 mole percent relative to $Al_2O_3$.

6. Recording sheet according to claim 1, wherein the support is selected from the group consisting of coated or uncoated paper, transparent or opaque polyester or fibrous textile materials.

7. Coating compositions for the preparation of ink-receiving layers for recording sheet for ink jet printing according to claim 1.

8. A method of preparing a recording sheet for ink jet printing comprising the steps of:

providing a support;

preparing a coating solution comprised of nanocrystalline, nanoporous aluminum oxide or aluminum oxide/hydroxide, wherein said oxide or oxide/hydroxide is prepared in the absence of acids and has been treated with aluminum chlorohydrate added as a solid or as an aqueous solution in the quantity from 0.1 to 7.0 mole percent relative to $Al_2O_3$;

coating said coating solution on said support to produce the recording sheet with improved storage stability and substantially no bronzing.

9. The method according to claim 8, wherein said support is selected from the group consisting of clear films made from cellulose esters, cellulose triacetate, cellulose acetate, cellulose propionate or cellulose acetate/butyrate; polyesters, polyethylene terephthalate or polyethylene naphthalate, polyamides, polycarbonates, polyimides, polyolefins, polyvinyl acetals, polyethers, polyvinyl chloride and polyvinylsulfones; polyethylene terephthalate; polyethylene naphthalate; baryta paper, polyolefin coated papers; uncoated papers, pigmented papers, cast-coated papers; metal foils, foils made from aluminum; textile fiber; polyamides, polyesters, cotton, viscose and wool.

10. The method according to claim 8, wherein said coating solution forms an ink receiving layer.

11. The method according to claim 10, further comprising a subbing layer between said support and said ink receiving layer.

12. The method according to claim 11, wherein said subbing layer is coated with said coating solution.

13. The method according to claim 8, wherein the surface of said support is subjected to a corona-discharge treatment or a corona-aerosol treatment prior to coating with said coating solution.

14. The method according to claim 8, wherein the coating solution further comprises at least one material selected from the group consisting of aluminum chlorohydrate, lanthanum and thiodiethylene glycol.

15. The method according to claim 14, wherein said aluminum chlorohydrate is an aqueous solution that has been aged for a period of at least two hours to 168 hours at temperatures between 25° C. and 100° C.

* * * * *